United States Patent [19]

Mullican

[11] Patent Number: 4,820,112

[45] Date of Patent: Apr. 11, 1989

[54] CLAW ATTACHMENT FOR BACKHOES AND EXCAVATORS

[76] Inventor: Ralph Mullican, P.O. Box 688, Yuba City, Calif. 95992

[21] Appl. No.: 165,617

[22] Filed: Mar. 8, 1988

[51] Int. Cl.[4] ..... B66C 3/02

[52] U.S. Cl. ..... 414/704; 37/DIG. 3; 294/104; 414/912

[58] Field of Search ..... 414/704, 740, 912, 694; 37/DIG. 3, DIG. 12, 2 R, 117.5; 294/104; 172/700

[56] References Cited

U.S. PATENT DOCUMENTS 3,807,589 4/1974 Shovick ..... 414/694 X
4,466,494 8/1984 Hanson ..... 414/740 X

FOREIGN PATENT DOCUMENTS 761783 6/1967 Canada ..... 414/740
253642 2/1912 Fed. Rep. of Germany ..... 172/700

*Primary Examiner*—Frank E. Werner
*Assistant Examiner*—Donald W. Underwood
*Attorney, Agent, or Firm*—Mark C. Jacobs

[57] ABSTRACT

A claw attachment for use in conjunction with the bucket of a backhoe or excavator for removing large boulders and other objects from the surface of the ground or from a partially embedded position within the ground. The claw is removably mounted in a fixed bracket on the earth moving machine and can be secured in a first or operative position on the "crowd" and then relocated to a second or storage position on said "crowd". In configuration, the claw resembles the claw of a Maine lobster, but with a pair of normally disposed outward extending ears toward the front thereof.

8 Claims, 3 Drawing Sheets

FIG. 13III

CLAW ATTACHMENT FOR BACKHOES AND EXCAVATORS

BACKGROUND OF THE INVENTION

Excavators and backhoes come equipped with a bucket to excavate earth and other material. These machines are designed to load their buckets toward the operator. The power pull is toward the machine. The bucket of such machines is not shaped to dig out rocks or other objects that may be partially disposed within the ground. While power can be applied to the bucket in an outbound direction, little use can be made of such power.

Typical manufacturers of such machines include J. I. Case, Ford, John Deere, Caterpillar, and perhaps Massey Ferguson, as well as Kubota and other Japanese companies.

One of the problems that these machines suffer is their inability to grasp large items such as boulders, or pieces of woods. These machines are best suited for granular material such as gravel or dirt which can be scooped up. Earth moving equipment is quite expensive, and therefore the need to do double duty, i.e. lift and carry large bulky items as well as scoop granular or loamy material is also needed. This need has been addressed by the prior art.

One such item is the Hoe clamp brand of clamping arm. This device which is covered by U.S. Pat. No. 4,519,739, is an active device in that it utilizes the bucket cylinder for clamping force. Another prior art device, which is intended primarily for Ford backhoes is the Big Thumb brand attachment. It is the subject matter of U.S. Pat. No. 3,273,729. It operates through the bucket control handle and utilizes the parent backhoe's hydraulic system.

Reference is made to the Industrial Equipment Attachment Guide, 3rd edition, published by John Deere Company, Moline Ill. A plurality of bucket clamp manufacturers names are set out, all of whose products are adapted to hold oversize, bulky, or unwieldy objects within the bucket of a Deere backhoe or excavator.

Many of the prior art units are hydraulically operated, a fact which places great strain on the hydraulic system of the earth moving machine. There is a need therefore for a low cost easily mountable non-hydraulic claw which can be readily utilized by a plurality of earthmovers.

It is an object of this invention to provide a low cost non-hydraulic claw for use with a backhoe or excavator bucket.

It is another object to provide a backhoe claw that can be mounted upon the crowd of an excavator and moved from a stowed position thereupon to an operative position quickly and easily.

Yet another object is to provide an improved claw that can better hold odd shaped objects within the excavator bucket.

A further object is to provide a claw that can be utilized with a plurality of manufacturers earth moving equipment.

These and other objects of the invention will in part be obvious and will in part appear hereinafter.

The invention accordingly comprises the apparatus possessing the construction, combination of elements and arrangement of parts which are exemplified in the following detailed description taken in connection with the accompanying drawings.

SUMMARY OF THE INVENTION

A non-hydraulic claw for attachment to the crowd of a backhoe or excavator for digging out bulky items such as logs or rocks partially embedded in the ground and for aiding the bucket (dipper) in the carrying of said bulky items. The claw in its first embodiment includes a clamp section comprising a main body portion, having two different radii top and bottom surfaces in the main section, a forward blunt nose, a terminal mount section at the rear end, and a stowage portion on the underside thereof. A pair of outward extending ears are mounted one on each side of the main body portion. The claw further includes a mounting bracket for receiving the clamp section.

The main body portion can be a single member as in the first embodiment or a pair of connected spaced members as in the seconds embodiment. In the second embodiment, the stowage portion is optional.

DESCRIPTION OF THE PREFERRED EMBODIMENT

Figure 1:
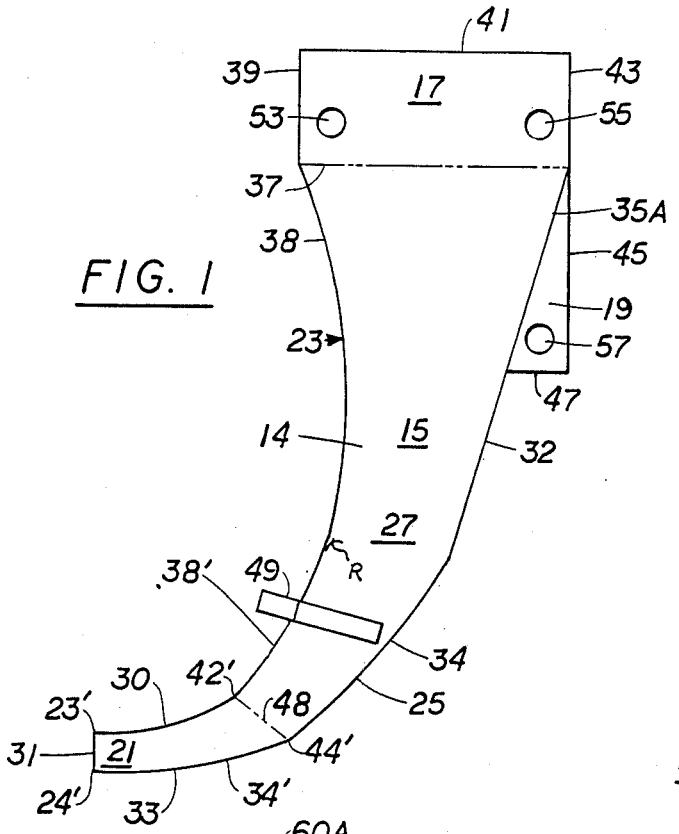
FIG. 1 is a side view of one portion of this invention's first embodiment.
Figure 2:
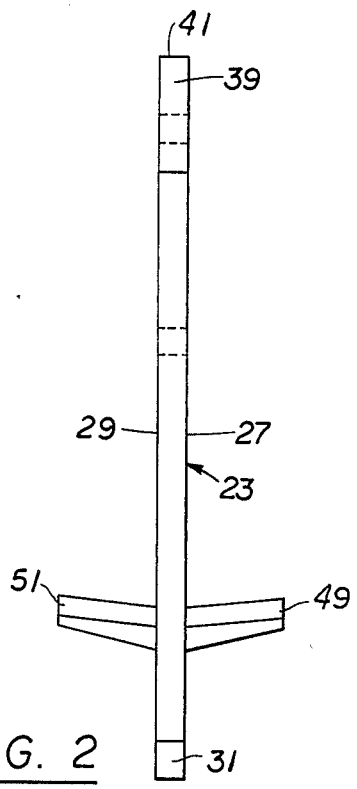
FIG. 2 is a front view thereof.
Figure 3:
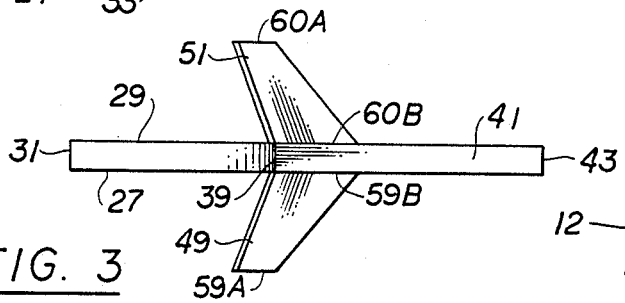
FIG. 3 is a top plan view thereof.

Reference is now made to FIGS. 1–3. The following nomenclature is utilized herein. The claw 11 consists of the clamp and the mount bracket. The clamp 13, consists of a main body portion, 14, —which in turn has three sections, a rear mount section, 17; a main section, 15; and a nose, 21; —, a pair of ears 49 and 51 (see FIG. 3); and a stowage portion 19, this last being optional.

Clamp 13 is best seen in FIG. 1, where it is shown oriented into its operative position. Clamp 13 has a main body portion 14 which terminates at its forward end in a blunt nose 21. A rear mount section 17 is contiguous with main body portion 14's main section 15, thereby forming a unitary structure. Depending from the underside of clamp 13 is a stowage portion 19, which is used for securing the claw 11 in its second or inoperative storage position relative to the crowd of the excavator or backhoe.

Body portion 14's main section 15, which may be hollow or solid has a pair of spaced side walls 27, 29 a top curved surface 23 of first radius 38, a second radius 38', a bottom curved surface 25 formed of radius 34, and straight edge 32. The main section is bounded on the bottom by imaginary line 48 which runs between points 42' and 44'.

Nose section 21 of said body portion, located at the distal end thereof, contiguous to the main section 15 therefore has side walls formed of portions of walls 27, 29. Nose section 21 is bounded by a forward edge 31, which commences at point 23', —the forward end of surface 23 and terminates at point 24'. Depending downwardly and rearwardly from points 23' and 24' respectively are first inner radius 30 and first outer radius 34'. These end respectively at points 42' and 44'. Imaginary line 48 running between points 42' and 44' complete the definition of the nose.

By utilizing different radii for the top surface, 23 from the radii used for the curved part of the bottom surface, the nose section 21 can be designed to depend forwardly of the rear mount section and yet maintain structural strength.

Radius 30 commences at point 23' and terminates at point 42', while radius 34' runs from point 24' to point 44'. Radius 38' runs from point 42' to point "R", while radius 38 runs from point "R" to a junction at wall 39. Wall 37 extends normal to wall 39 to wall 43.

The rear mount section 17 disposed at the distal end of said body portion 14, is a rectangular section, integral with and adjacent to main section, 15. It is bounded by an upper surface 39, a rear surface 41, bottom surface 43, and an imaginary line 37 which acts to define a separation of section 15 from section 17. A typical extension for upper surface 39 is about six to eight inches, while rear surface 41 can be about 26" long. Mention can also be made that the non-radiused area 32 of surface 25 may typically be about 37".

In the embodiment shown, wall 37 is an imaginary line since the thickness i.e. the depth of the main body portion and the rear mount section are the same. Such a line of demarcation is of course not required. If one of the portion 15 and the section 17 is of greater depth then wall 37 would extend either forwardly toward the reader, or rearwardly away from the reader or in both directions if one of said elements 15 or 17 is centered relative to the other.

A throughbore 53 is disposed inwardly from surface 39 and downwardly from wall 41, and a second throughbore 55 is disposed an equal distance from walls 43 and 41. These bores are used for the disposition of claw 11 within the mounting bracket as will be discussed supra.

The stowage portion 19 which is annexed to the zone 35A of non-radiused area 32 can be the same depth or a different depth from the main body portion and the rear mount section. It is preferred, for ease of manufacture that all three portions be of similar depth or thickness. Thus 19 is defined as being generally triangular and being bounded by bottom wall 45, upstanding wall 47 and zone 35A which forms a boundary between the main section of the clamp and the stowage portion.

Throughbore 57 is almost horizontally aligned with throughbore 55 found in the rear mount section 17 of claw 11. Wall 45 may be a continuation of wall 43, or a slight upward angle may be formed at the junction thereof.

The purpose of the stowage portion 19 is to reposition the apparatus of this invention in a more convenient location on the crowd during periods of highway travel and during periods of non use of the backhoe or excavator. Portion 19 is seen therefore to be optional, in that it does not contribute to the main purpose of this apparatus.

When portion 19 exists, it is used by placing a mount pin, not seen, into throughbore 57 and another pin into throughbore 55 from the mount bracket in conventional fashion.

Turning now to the ears 49 and 51. In FIG. 1, ear 49 is seen disposed on side wall 27 of the main body portion, 14. As seen in FIG. 3, ears 49 and 51 are each a mirror image of the other and are of a trapezoidal configuration. Preferably, the two bases 59A & B, are parallel as are their counterparts 60A & B. These ears, are disposed to extend outwardly in a normal relationship to the side walls 27 and 29. As is seen in FIG. 3, said ears 49 and 51 are swept upwardly and as is seen in FIG. 1, they are inclined rearwardly slightly from back to front.

Figure 4:
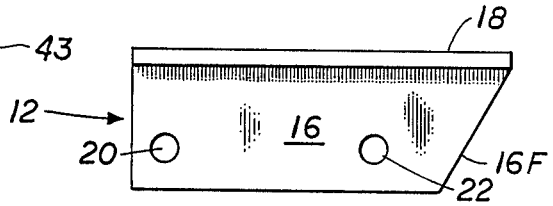
FIG. 4 is a side view of another portion of the first embodiment of this invention.
Figure 5:
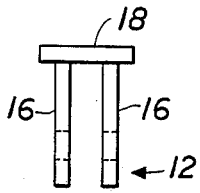
FIG. 5 is a front end view of the portion of the invention shown in FIG. 4.
Figure 6:
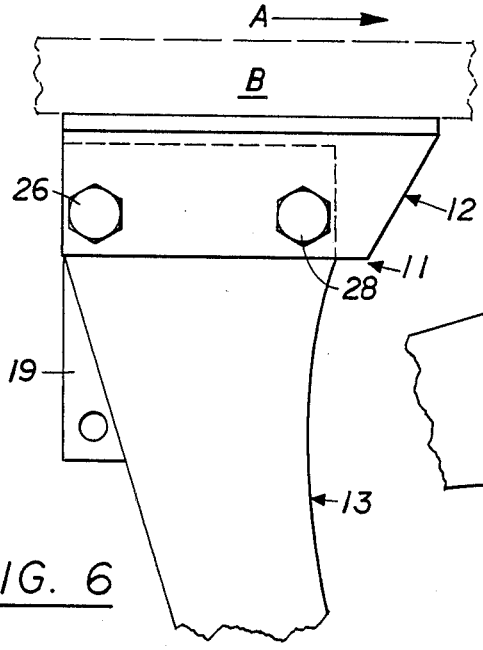
FIG. 6 is a left side elevational view showing the first embodiment of this invention mounted in its operative position on the boom of a backhoe.
Figure 7:
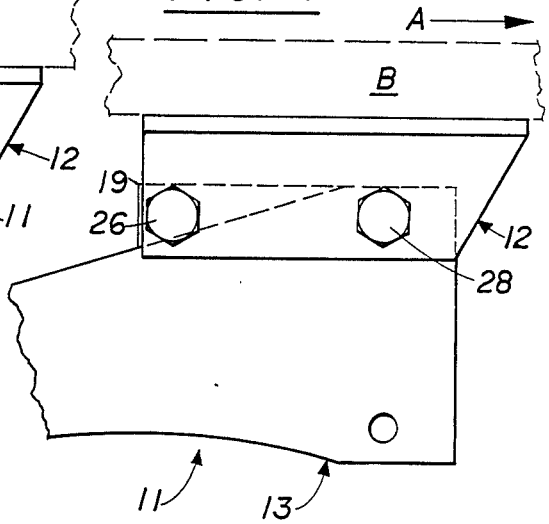
FIG. 7 is a partial left side elevational view showing the first embodiment of this invention mounted in its stowed position on the crowd of a backhoe.

Turning to FIGS. 4 & 5 it is seen that the mount bracket 12, comprises an upper member 18 and a pair of spaced parallel side members 16 mounted normally thereto, and spaced in from the side edges of top member 18, per FIG. 5. The two side members 16 may be rectangular in configuration, or preferably have a slanting forward wall which depends rearwardly from its point of beginning at the intersection with top member 18. This front wall is designated 16F. A part of throughbores 20 and 22 are axially and horizontally aligned in both side members 16, and of a dimension to be able to receive mounting bolts 26 and 28 best seen in FIG. 6. These bolts 26 and 28 are retained in place by suitable nuts 26' and 28' not shown. Note that there are a pair of throughbores 20 and 22, horizontally aligned on the side members 16. Obviously, each of the pair of throughbores 20 and the throughbores 22 must be axially aligned in order to properly receive the bolts 26 and 28. Reference is made to FIG. 6, which shows the clamp section 13 disposed within the mount bracket 12, which mount bracket, may be welded or otherwise applied to the crowd B of the excavator or backhoe. In the position shown in FIG. 6, which is the operative position, the clamp section is disposed within its mounting bracket by its rear mount section 17. In FIG. 7, however, the clamp section is mounted to the mount bracket by its stowage portion 19, as is readily discernable from said figure. This is the position for periods of non-operation. The arrow A in each of FIGS. 6 and 7 points to the front of the excavator toward the bucket.

Figure 9:
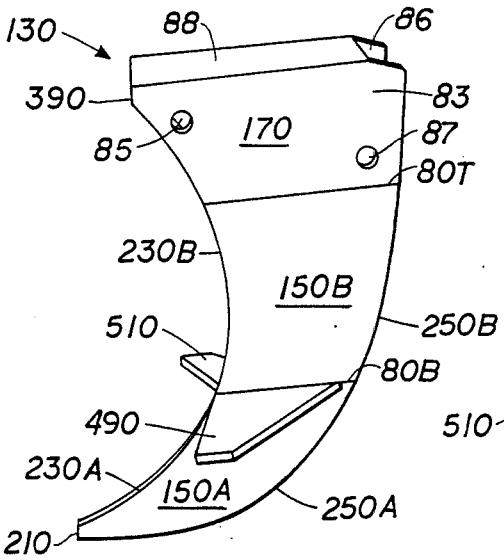
FIG. 9 is a side perspective view of the clamp section of the second embodiment.
Figure 10:
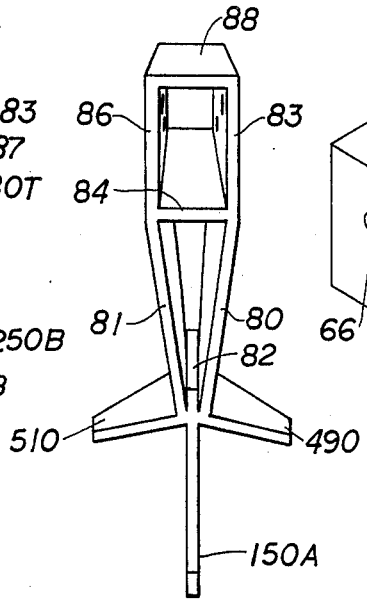
FIG. 10 is a front perspective view thereof.

Turning now to the figures pertaining to the second embodiment. It is seen from FIGS. 9 and 10, that the main body portion thereof is divided into two zones. The front zone, i.e. that portion between the ears and the blunt nose, is somewhat similar to the front zone, of the first embodiment. Though in the first embodiment a front zone was not defined as such. In FIG. 9 the front zone, 150A here in the second embodiment, lies between the ears and the termination of the two radii, 230A and 250A is of the same general configuration as seen from the side view, as is the first embodiment. However, the rear zone, 150B is structurally different as can be seen from FIG. 10. That is to say there are two aligned rear zones separated by spacer elements as will be defined below. Likewise, the rear mount section that is adjacent to the main body portion is also dual in that each rear zone has its own rear mount section annexed thereto. Since this second embodiment utilizes a dual rear mount section, it is necessary to widen the space between the side walls 63, 64 of the mount bracket, 62 as utilized for the first embodiment to accommodate this structure. Details of the mount bracket will be provided below in FIG. 11.

As to the stowage of this device in a non-operative position, while mere reverse mounting such that the claw points rearwardly rather than forwardly can readily be accomplished, in order to raise the claw further above the ground level, provision must be made for stowage by using a means similar to that provided with respect to the first embodiment. That is, a generally triangular portion on the underside mounted along wall 250B and configured similar to storage portion 19.

In the second embodiment as has been mentioned there are two zones for the main body portion. Rather than being designated 15 as in the first embodiment they are here designated 150A and 150B In FIG. 9, the ears 490 and 510 act as the point of separation of the two zones of the main body portion 150. Main body portion zone 150A is similar to that portion of main body 15 of the first embodiment, that extends from the ears to the blunt nose, and therefore only minimal discussion is required. A blunt nose 210 similar to blunt nose 21 is found at the forward end of zone 150A. A radius similar to the radius for the top surface 23 and for the bottom surface 25 are preferred for the surfaces or 250A and 230A. Here also the larger radius is found in the top surface namely 230A. The second zone of the main body portion namely 150B is seen to be disposed over a hidden section 82 of zone 150A (see FIG. 10). This hidden section is disposed within the two segments of 150B namely the upwardly and outwardly diverging walls 80 and 81. See FIG. 10. Section 82, is the proximal end of 150A, and commences at the proximal edge of the outwardly diverging normally disposed ears 490 and 510. The spaced apart members 80 and 81, also are of the radii 230B and 250B, both of which constitute continuing arc segments of the radius 230A and 250A respectively. Each of members 80 and 81 have as their other boundaries a pair of spaced horizontal walls designated 80T and B and 81T and B (not shown) respectively. The angle at which the two members 80 and 81 diverge outwardly may range widely. Mounting section 170 shown in FIG. 9, is disposed upon the spaced members 80 and 81. The mount section 170 which serves as the rear mount section comprises a pair of parallel spaced walls 84 and 88 which are designated as the separating wall 84 and the rear wall 88. Spaced from each other and disposed normal to said separator and rear walls are the side walls 83 and 86. See FIG. 10. A pair of axially aligned bores 85 and 87 are disposed in each of said side walls 83 and 86, offset from each other. See FIG. 9. Side walls 83 and 86, have a first surface that completes the radius that conforms to the radii 230B and 250B, and terminates in a segment 390 that corresponds to the upper wall 39 of the first embodiment. This segment 390 is normal to the rear of 88. Bolts similar to those shown in FIG. 6 namely bolts 26 and 28 are used to stow and to mount the second embodiment of this invention. It is noted from reference to FIG. 9 that if there is no stowage portion similar to 19 on this embodiment. However if desired one could be employed.

Figure 11:
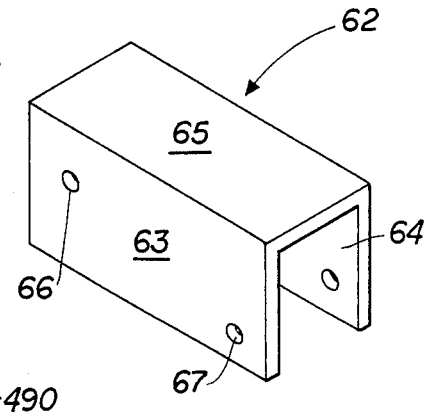
FIG. 11 is a perspective view of the mount bracket for the clamp section of the second embodiment shown in FIG. 9.

The mount bracket to be utilized herewith, is similar to the mount bracket in FIGS. 4 and 5, in that it is an inverted U-shaped article, but the spacing between the side members must be increased in order to allow for the span of the rear wall 88 and the separator wall 84. This mount bracket 61 is shown in FIG. 11. Note that the mount bracket 62 has generally rectangularly configured spaced side walls 63 and 64 with a top wall 65. In order to use similar stock for the top wall 65 as for top member 18, (see FIGS. 4 and 5) the sides 63 and 64 are not spaced in from the outer edges of top wall 65, but this savings is of course not required. The bores within the members 63 and 64 namely bores 66 and 67 are axially aligned to correspond in relative positioning to each other to the axially aligned throughbores 85 and 87 of the clamp section 130.

The advantage of the second embodiment over the first, is better structural integrity, but the trade off is the increased cost of manufacture.

Figure 8:
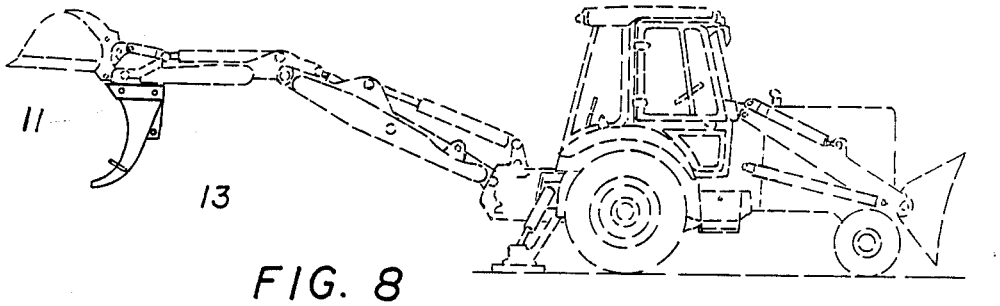
FIG. 8 is a side view of a J. I. Case backhoe showing the first embodiment of this invention in operative position adjacent the bucket of the backhoe.

The disposition of the claw of the second embodiment, on the boom of the backhoe or excavator would be similar to that shown in FIG. 8 for the first embodiment. Therefore no further discussion is needed on this point.

It is seen that I have provided a claw for use with excavators and backhoes, that does not require the use of the hydraulic system of the earthmoving machine. This allows the full power to be applied to the operation of the bucket. The design of the devices of this invention permit them to be utilized with the earth moving machines of various manufacturers. It is well within the skill of the art to determine the location on the stick or crowd for the disposition of the mounting bracket. The inclusion of the outwardly depending ears, enables the devices of this invention to manipulate and manuever partially buried items. The ears also permit the better balancing of bulky non-uniformly configured items by the claws of this invention, when such are used in conjunction with the buckets for the carrying of these bulky and non-uniform items typically large boulders.

Figure 12:
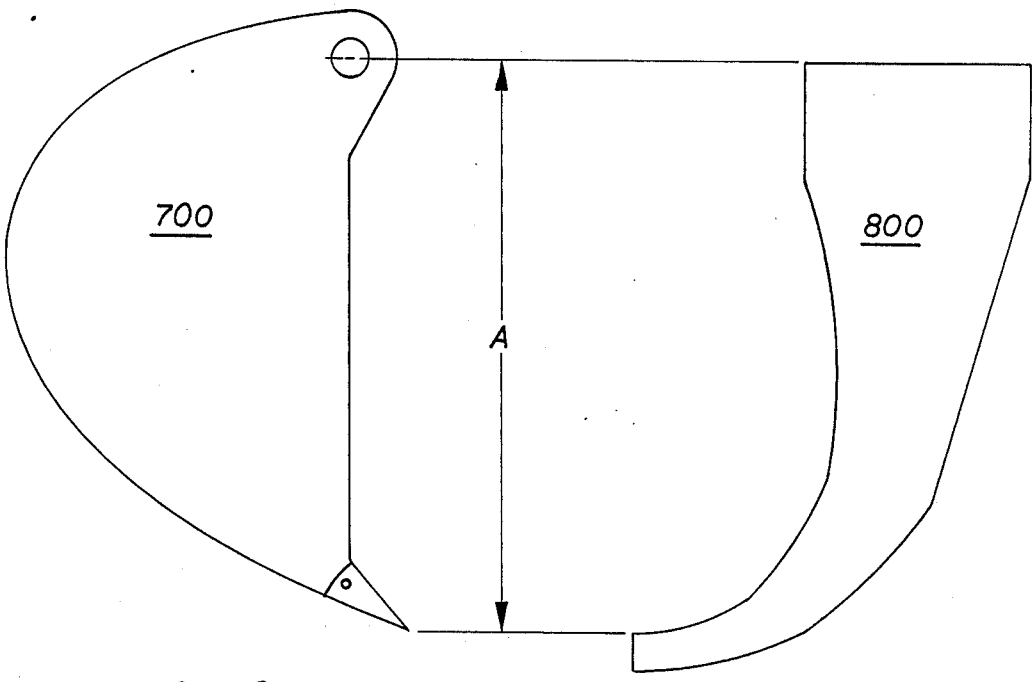
FIG. 12 is a diagrammatic side elevational view of a bucket and a claw according to this invention, side by side.
Figure 13I:
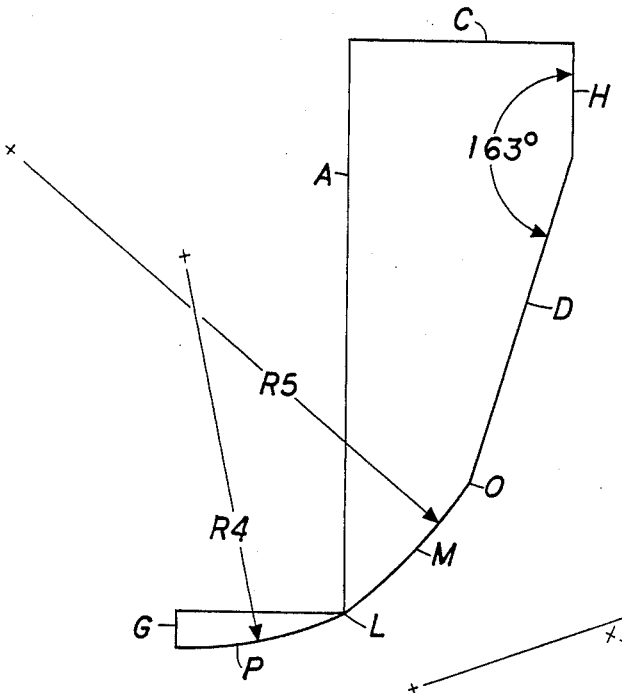
FIGS. 13-I, II, III and IV are diagrammatic views utilized to illustrate the sizing of the apparatus of this invention.
Figure 13I:
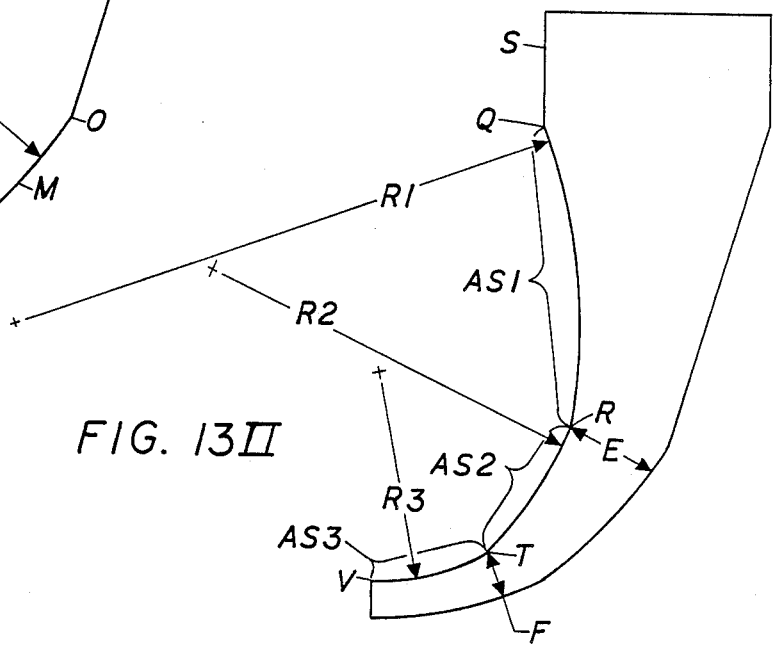
Figure 13I:
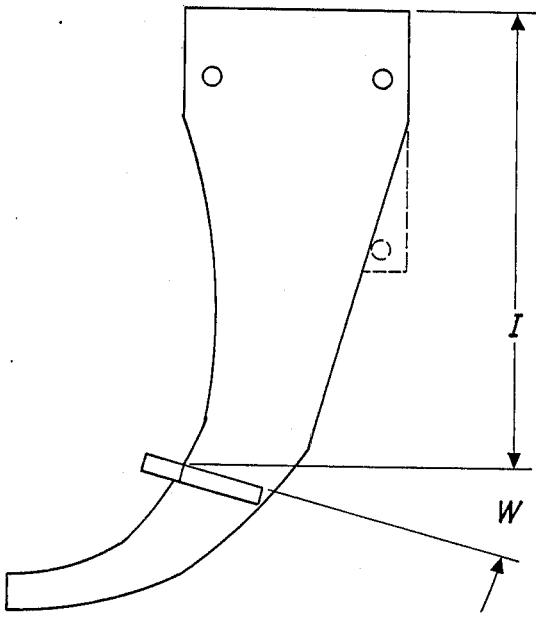
Figure 13I:
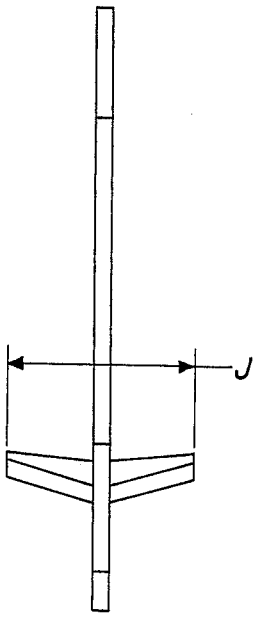

In order to properly size the claw attachment of this invention, which device is always used in conjunction with a bucket on the backhoe or excavator, one must make a measurement determination from the bucket. The discussion that follows pertains primarily to the first embodiment, but the second embodiment's exact configuration, would be calculated in a similar fashion. Reference is made to FIG. 12 wherein a backhoe bucket 700 and a device according to the first embodiment of the invention, 800, are shown in outline. Distance A is measured from the center of the bucket pin to the tip of the teeth of the bucket. This distance A varies arbitrarily according to the desires of the manufacturer for his particular machine.

Reference should now be made to FIG. 13 which consists of a series of sub-diagrams which illustrate the text to follow on the sizing for construction of the first embodiment of this invention. While not discussed in detail, the second embodiment would be sized in a similar fashion. It has been determined that 2" thick flat stock gives rise to a strong claw attachment suitable for working with any backhoe or excavator.

Turning first to FIG. 13-I, the line A is drawn to correspond in length to measurement A (see FIG. 12). Line C is extended normal to line A and in length is equal to A/2.5. Line H is extended downwardly normal to line C and its extension is set at 6" when A is less than 40" or at about 8" when A is more than 40".

Line D commences at the end of line H down to point O. The angle X between H and D is about 163 degrees.

Arc segment M which runs from point O to point L is determined according to radius 5. Radius 5 equal the length A expressed in the terms of extension of the radius of a circle is equal to the dimension of A.

Arc segment P corresponds to radius 4. It commences at point, L and runs to a point of termination at the commencement at the lower end of line G. G is parallel to A and is about 2".

B commences at the upper end of line G. i.e. point V and is an imaginary line extending a distance of A/3.33, and is normal to A. B is termed an imaginary line, since it is used to construct other lines, and does not correspond to any dimension of the device of this invention.

Reference should now be made to FIG. 13-II. Side S is seen to be parallel to and equal in length to line H. S is formed along line A, our original reference line.

Line AS1 is an imaginary line commencing at point Q and extending to point R and is equal in extension to A/1.667, and geometrically is designated a chord. Radius 2 which commences at point R and runs to point T is a radius equal to A/1.45. The chord AS2=A/3.7255.

Radius 3 equals A/2.75, and commences at point T and extends to point V. AS3, the chord is equal to about A/4.634.

Distance E and F are reference widths taken at convenient locations. E is a dimension that is taken at about a 110 degree angle to AS1. E extends from the point R to a point along radius 5 and is equal to A/6.333 at this 110 degree angle.

Reference line F is a continuation of radius 3 and is sized at A/12. It commences at point T, the commencement of radius 3, and is at about a right angle to AS-3, and extends to radius 4.

Turning now to FIG. 13-III where reference dimension I is shown. It is a measurement dimension and is equal to A/1.25.

Angle W is used to properly orient ear 49 relative to clamp section 13. Angle W is about 15 degrees.

The lateral extent of the two ears in conjunction with clamp section 13, as seen in FIG. 13-IV is designated J and is set at A/3.

Dimension Z seen in FIG. 11 is equal to 1.25 times C, which as noted above is A/2.5.

To recapitulate the varying dimensions all based upon A, a table is set forth below reciting same.

| | |
|---|---|
| DISTANCE | B = A/3.33 |
| | C = A/2.5 |
| | D = A/1.667 |
| | E = A/6.333 |
| | F = A/12 |
| | G = 2" |
| | H = 6" when A is 40" or less, 8" when A is over 40" |
| | I = A/1.25 |
| | J = A/3 |
| | K = 2" when A is 40" or under and 3" when A is over 40" |
| | Z = plate 25% longer than C |
| | AS1 = A/1.667 |
| | AS2 = A/3.7255 |
| | AS3 = A/4.634 |
| RADIUS | 1 = A |
| | 2 = A/1.45 |
| | 3 = A/2.75 |
| | 4 = A/1.46 |
| | 5 = A |

In order to define the article, first line A would be set out, and the relationships established for the first embodiment would be employed as applicable. Thus the suggested typical dimensions for the mount section recited above, would still be applicable here. The same is true as well for the difference in the radii of the upper and lower curved surfaces. Typically distance "A" ranges between 36 and 75 inches.

Distance A which is the basis for all other measurements typically ranges between about 36" to about 75".

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A non-hydraulic claw for attachment to the crowd of a backhoe or excavator for removing boulders and other large objects from the ground in cooperation with the bucket of the backhoe or excavator, which claw comprises:

a clamp having a main body portion, which body portion has a blunt nose section at the distal end of a main section and a rear mount section at the proximal end of the main section, and a pair of trapezoidal ears extending outwardly and forwardly on each side of the main body portion of said clamp, said ears being disposed normal to the main body portion.

including a generally triangular stowage portion on the underside of the main section of the body portion, said stowage portion having a throughbore therein, said claw being removably mountable in a first operative position in a mounting bracket fixedly mountable on said crowd, by the rear mount section of the clamp and being removably mountable in said bracket in a second storage position by its rear mount section and its stowage portion.

2. A non-hydraulic claw for attachment to the crowd of a backhoe or excavator for removing boulders and other large objects from the ground in cooperation with the bucket of the backhoe or excavator, which claw comprises:

a clamp having (a) a main body portion, which body portion has a nose section at the distal end of a main section and a rear mount section at the proximal end of the main section, and a pair of ears extending outwardly and forwardly on each side of the main body portion of said clamp, wherein the main body portion of the clamp has a pair of spaced side walls, a top radiused surface, a bottom radiused surface, said bottom radiused surface having an overall radius less than the overall radius of the top surface, said radiused surfaces converging to said nose section said claw being removably mountable in a first operative position in a mounting bracket fixedly mountable on said crowd.

3. The apparatus of claim 1, wherein the rear mount section of said main body portion is a generally rectangular section integral with the main section of the body portion, and which section has a pair of aligned throughbores spaced from and parallel to the rear surface thereof.

4. A non-hydraulic claw for attachment to the crowd of a backhoe or excavator for removing boulders and other large objects from the ground in cooperation with the bucket of the backhoe or excavator, which claw comprises:

a clamp having (a) a main body portion, which body portion has a nose section at the distal end of a main section and a rear mount section at the proximal end of the main section, and a pair of ears extending outwardly and forwardly on each side of the main body portion of said clamp, wherein the main body portion is divided into two zones a front zone and a rear zone, and the rear zone comprises a pair of spaced members that converge at the front zone, and which members are separated therefrom by the ears, said claw being removably mountable in a first operative position in a mounting bracket fixedly mountable on said crowd.

5. The apparatus of claim 4 wherein the mount section comprises a pair of spaced side members, a rear wall and a separator parallel to the rear wall, said separator segregating the main section from the mount section.

6. The apparatus of claim 1 in combination with a mounting bracket, wherein the mounting bracket is an inverted U-shaped structure, said bracket being fixedly mounted on the crowd of a backhoe or excavator.

7. The apparatus of claim 1 in combination with a mounting bracket wherein the mounting bracket is an inverted U-shaped structure said bracket being fixedly mounted on the crowd of a backhoe or excavator.

8. The apparatus of claim 4 wherein the ears are normal to the main body portion and level.

* * * * *